US007100505B2

(12) United States Patent
Fujiwara

(10) Patent No.: US 7,100,505 B2
(45) Date of Patent: Sep. 5, 2006

(54) PRINTING PRESS HAVING PLATE SUPPLY DEVICE WITH AXIALLY MOVABLE SUCKER

(75) Inventor: Shigeo Fujiwara, Fuchu (JP)

(73) Assignee: Ryobi Ltd., Hiroshima-ken (JP)

( * ) Notice: Subject to any disclaimer, the term of this patent is extended or adjusted under 35 U.S.C. 154(b) by 0 days.

(21) Appl. No.: 11/159,721

(22) Filed: Jun. 23, 2005

(65) Prior Publication Data

US 2005/0284321 A1 Dec. 29, 2005

(30) Foreign Application Priority Data

Jun. 25, 2004 (JP) ..... 2004-188023

(51) Int. Cl.
*B41F 27/12* (2006.01)

(52) U.S. Cl. ..... 101/477; 101/415.1; 101/481

(58) Field of Classification Search ..... 101/415.1, 101/477, 479, 480, 216, 378, 481, DIG. 36
See application file for complete search history.

(56) References Cited

U.S. PATENT DOCUMENTS 5,406,888 A * 4/1995 Sugiyama et al. ..... 101/415.1
6,463,854 B1 * 10/2002 Rautert et al. ..... 101/481

FOREIGN PATENT DOCUMENTS

JP 05-026374 U 4/1993
JP 07-290690 11/1995
JP 2844231 B 10/1999
JP 3066614 B 5/2000

* cited by examiner

*Primary Examiner*—Leslie J. Evanisko
(74) *Attorney, Agent, or Firm*—The Webb Law Firm

(57) ABSTRACT

A printing press can securely supply a printing plate while bringing a printing plate into alignment with a plate cylinder in an axial direction of the plate cylinder, as well as omitting the necessity to return the plate registration of the plate cylinder to the original point. The printing press includes a printing plate guide plate that is pivotally movably mounted in an opening of a body cover that covers the plate cylinder, a sucker for holding a printing plate by suction so as to pull the same towards the printing plate guide plate. The sucker is disposed so as to be movable towards a clamping gripper disposed on the plate cylinder and in a direction parallel to an axis of the plate cylinder.

3 Claims, 10 Drawing Sheets

PRINTING PRESS HAVING PLATE SUPPLY DEVICE WITH AXIALLY MOVABLE SUCKER

CROSS REFERENCE TO RELATED APPLICATION

This application claims priority from Japanese Patent Application No. 2004-188023, which is incorporated herein by reference.

BACKGROUND OF THE INVENTION

1. Field of the Invention

The present invention relates to a printing press and more particularly a structure of a printing section disposed between a sheet feeding section and a sheet discharge section so as to supply a printing plate to a clamping gripper that is disposed on a plate cylinder and to mount the supplied printing plate on the plate cylinder.

2. Related Art

A sheet-fed printing press (hereinafter referred simply to a printing press) generally includes a printing section between a sheet feeding section and a sheet discharge section. This printing section is to print on sheets by a printing plate mounted on a plate cylinder. There is a necessity to mount a printing plate on the plate cylinder with accurate alignment. For mounting a printing plate on the plate cylinder, the printing press is generally equipped with a printing plate mounting device that automatically mounts a printing plate, which has been manually inserted into a clamping gripper disposed in the plate cylinder. According to a recently proposed printing press, an automatic supply mechanism is employed to automatically supply a printing plate (a new plate), which has been once set at a predetermined position by an operator, to a clamping gripper. For example, Japanese Patent No. 2844231 proposes an automatic plate supply device that has a sucker arranged on a printing plate guide plate disposed on the front side of a body cover of the printing section for sucking a printing plate (plate rear side). According to a technique of this Patent, the printing plate guide plate with the printing plate held by the sucker is inclined towards the clamping gripper of the plate cylinder and the sucker is linearly moved towards the clamping gripper so as to supply the printing plate to the clamping gripper.

Meanwhile, in supplying each printing plate to the clamping gripper, the printing plate is brought into alignment with the clamping gripper (plate cylinder) by the engagement between a pair of axially spaced apart protrusions as an engaging means formed on the clamping gripper and cutouts as an engaged means formed in each printing plate. In this arrangement, the sucker holds by suction a printing plate which has been laid down on the printing plate guide plate and moves towards the clamping gripper while holding the printing plate. If the printing plate on the printing plate guide plate is axially displaced relative to a given position, the engaged means of the printing plate is unlikely to be in alignment with the engaging means so that, with the printing press of this type, which automatically drives the clamping gripper, a signal generated upon the alignment of a printing plate with the plate cylinder is not output, and hence the clamping gripper cannot be controlledly driven. This makes it impossible to mount the printing plate on the plate cylinder. In order to address this problem, for example, Japanese Utility Model Application Laid-open No. Hei-05-26374 proposes a technique in which a guide piece is arranged on the printing plate guide plate for guiding a printing plate along a lateral side edge thereof so as to bring the engaged means of the printing plate into alignment with the engaging means of the clamping gripper. For achieving this alignment in the printing press of this type, the plate cylinder must be previously returned to a given axial position (original point) proper for a printing plate to be newly supplied, as described in for example Japanese Patent No. 3066614. The returning of a plate registration (the axial position) of the plate cylinder to the original point (position) is required for the reason that if the plate registration (the axial position) of the plate cylinder has been displaced from a proper position after the use of the printing plate for the last printing operation, a newly supplied printing plate for the subsequent printing operation may not match the plate registration (the axial position of the plate cylinder), and as a result, it is not possible to bring the cutouts as the engaged means of the printing plate into engagement with the protrusions as the engaging means of the clamping gripper.

The above conventional printing press is provided with a guide piece arranged on the printing plate guide plate so as to guide a lateral edge of the supplied printing plate. This guide piece is fixed in position on the printing plate guide plate and therefore, if the mounting position of the printing plate guide plate relative to the body cover is not accurate, the alignment of the engaged means with the engaging means may not be possible. Also, as another disadvantage associated with the prior art, it is necessary to perform an additional step of returning the plate registration (axial position) of the plate cylinder to the original point (position) in order to make the cutouts as the engaged means match with the protrusions as the engaging means of the clamping gripper of the plate cylinder.

It is an object of the present invention to provide a printing press that is capable of accurately bringing a printing plate into alignment with the plate cylinder by securely making the engaged means of the printing plate match in position with the engaging means provided on the side of the plate cylinder in supplying the printing plate to the plate cylinder, as well as omitting the necessity to return the plate registration of the plate cylinder to the original point.

SUMMARY OF THE INVENTION

According to the present invention, there is provided a printing press that includes: a plate cylinder for mounting a printing plate thereon; a clamping gripper disposed on said plate cylinder for gripping the printing plate; a printing plate guide plate on which a printing plate to be guided is mounted; a sucker for holding the printing plate by a suction force applied to a rear side of the printing plate so as to pull the printing plate towards the printing plate guide plate; a plate supply device for supplying the printing plate held by the sucker towards the clamping gripper; a support member provided in the plate supply device for movably supporting the sucker in a direction parallel to an axis of the plate cylinder; and engaging means being provided on the side of the plate cylinder for bringing the printing plate held by the sucker into a given position relative to the axis of the plate cylinder by engagement with engaged means formed in a leading edge of the printing plate so as to allow the printing plate to be brought into alignment with the plate cylinder relative to the axis of the plate cylinder.

With the thus structured printing press, when the printing plate held by the sucker is moved towards the clamping gripper disposed on the plate cylinder by using the plate supply device, the sucker, which is movable in a direction parallel to the axis of the plate cylinder while being supported by the support member, moves the printing plate towards the clamping gripper as adjusting the position of the printing plate in the axial direction of the plate cylinder, thereby allowing the engaged means of the printing plate to come into alignment with the engaging means with accuracy. Further, since the printing plate becomes movable in a direction parallel to the axis of the plate cylinder by making the sucker movable in a direction parallel to the axis of the plate cylinder, it is possible to omit the necessity to return the plate registration (axial position) of the plate cylinder to the original point (position) for bringing the plate cylinder into alignment with a new printing plate to be replaced with a used printing plate.

The printing press preferably further includes a moving member, through which the sucker is mounted to the support member in such a manner as to be movable in a direction parallel to the axis of the plate cylinder, and a switching means for switching the moving member so as to prevent the moving member from being moved in a direction parallel to the axis of the plate cylinder at a position at which the sucker starts holding of the printing plate by suction and allowing the moving member to be movable in a direction parallel to the axis of the plate cylinder at a position which the sucker reaches on its way towards the clamping gripper.

With this arrangement, the sucker is prevented from being moved in a direction parallel to the axis of the plate cylinder at a position, at which the sucker starts holding the printing plate by suction, and therefore is held in stationary position. Thus, it is possible to securely hold the printing plate by suction. Also, the sucker is released from such a stationary state at a position which it reaches on its way towards the clamping gripper by the switching means, allowing the printing plate to be adjusted in a direction parallel to the axis of the plate cylinder and hence the engaged means of the printing plate to be brought into alignment with the engaging means of the plate cylinder.

In the above printing press, the engaging means is preferably comprises in the form of a pair of protrusions, each having a cylindrical column shape disposed with a given distance from each other in a direction parallel to the axis of the plate cylinder, and the engaged means is preferably in the form of a pair of engaged members. At least one of the engaged members is preferably a cutout formed in the leading edge of the printing plate, in which the cutout has a width substantially equivalent to the diameter of a corresponding one of the pair of protrusions.

With this arrangement, in a case where a printing plate to be supplied to the clamping gripper is held at a position displaced from a correct position in the axial direction of the plate cylinder, a lateral side wall of the cutout is pressed by the outer circumference of the corresponding protrusion, thereby allowing the printing plate to be adjusted in position in the axial direction of the plate cylinder while being supplied towards the clamping gripper. These engaging means and engaged means may be varied in structure, arrangement, number, shape or the like, as long as the engaged means is brought into alignment with the positioning member based on the engagement therebetween.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Figure 1:
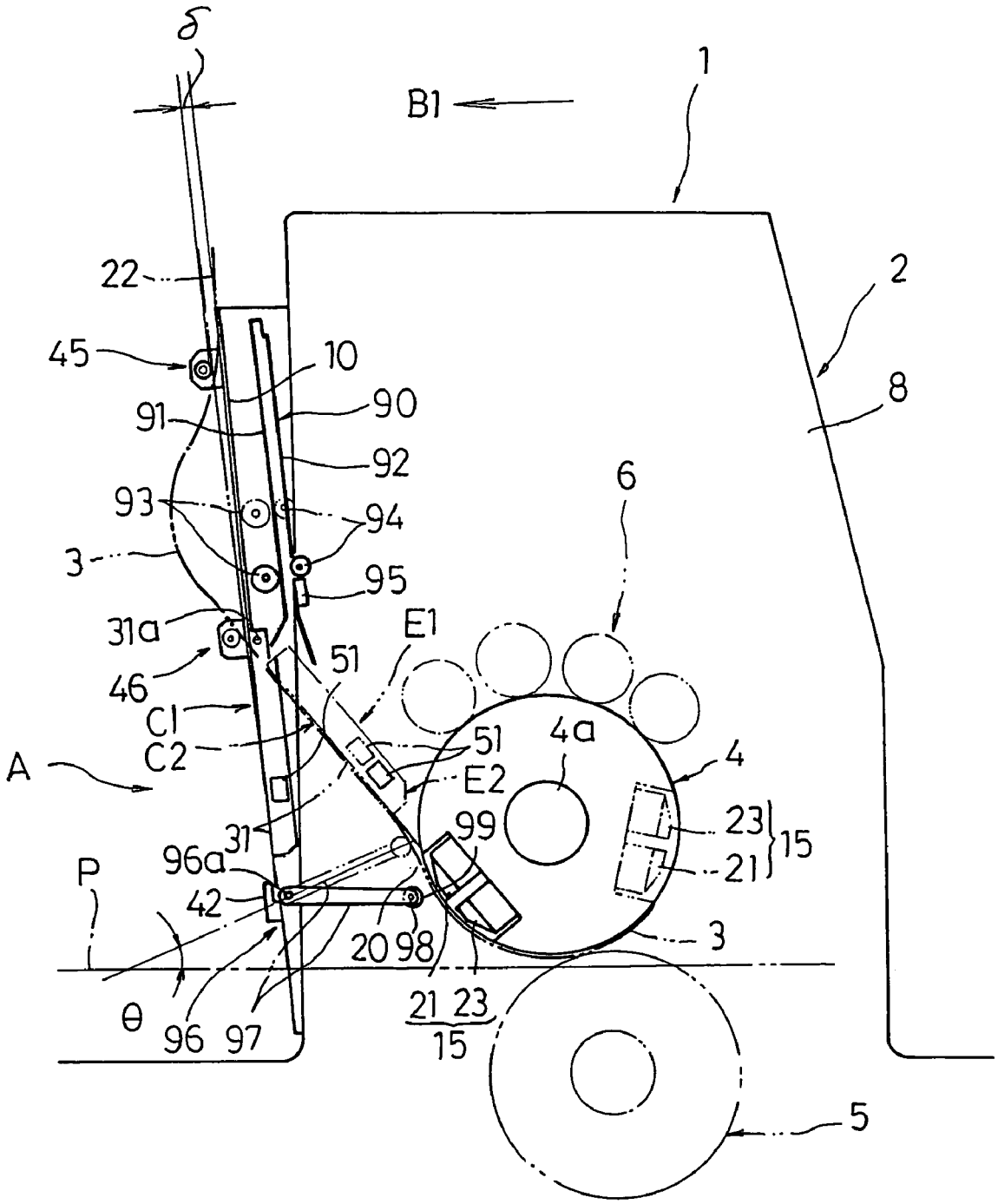
FIG. 1 is a schematic cross sectional view illustrating the motion of a printing press in a plate supply operation, according to an embodiment of the present invention.
Figure 2:
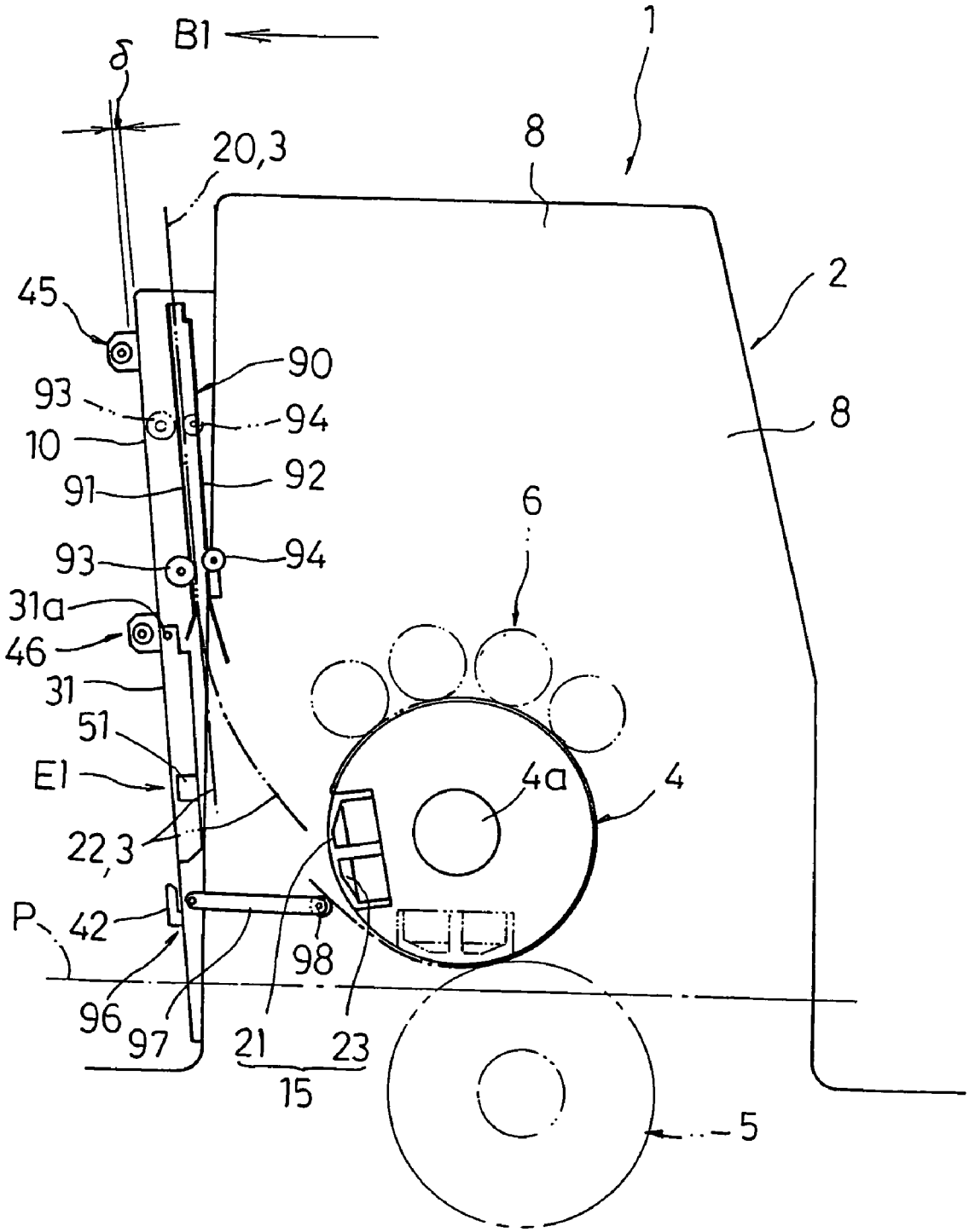
FIG. 2 is a schematic cross sectional view illustrating the motion of the printing press in a plate discharge operation.
Figure 3:
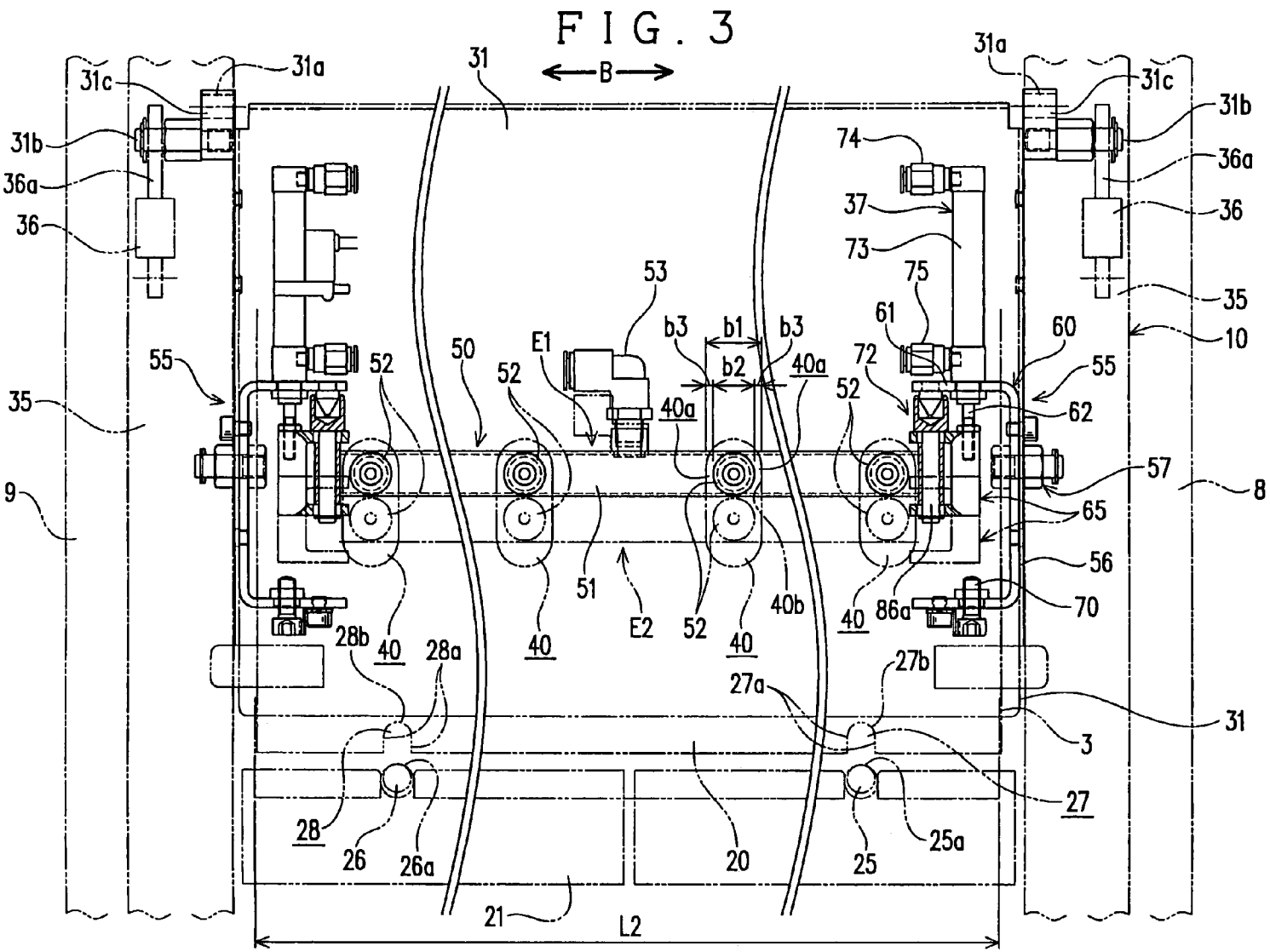
FIG. 3 is a rear view of a printing plate guide plate with a plate supply device of the printing press.
Figure 4:
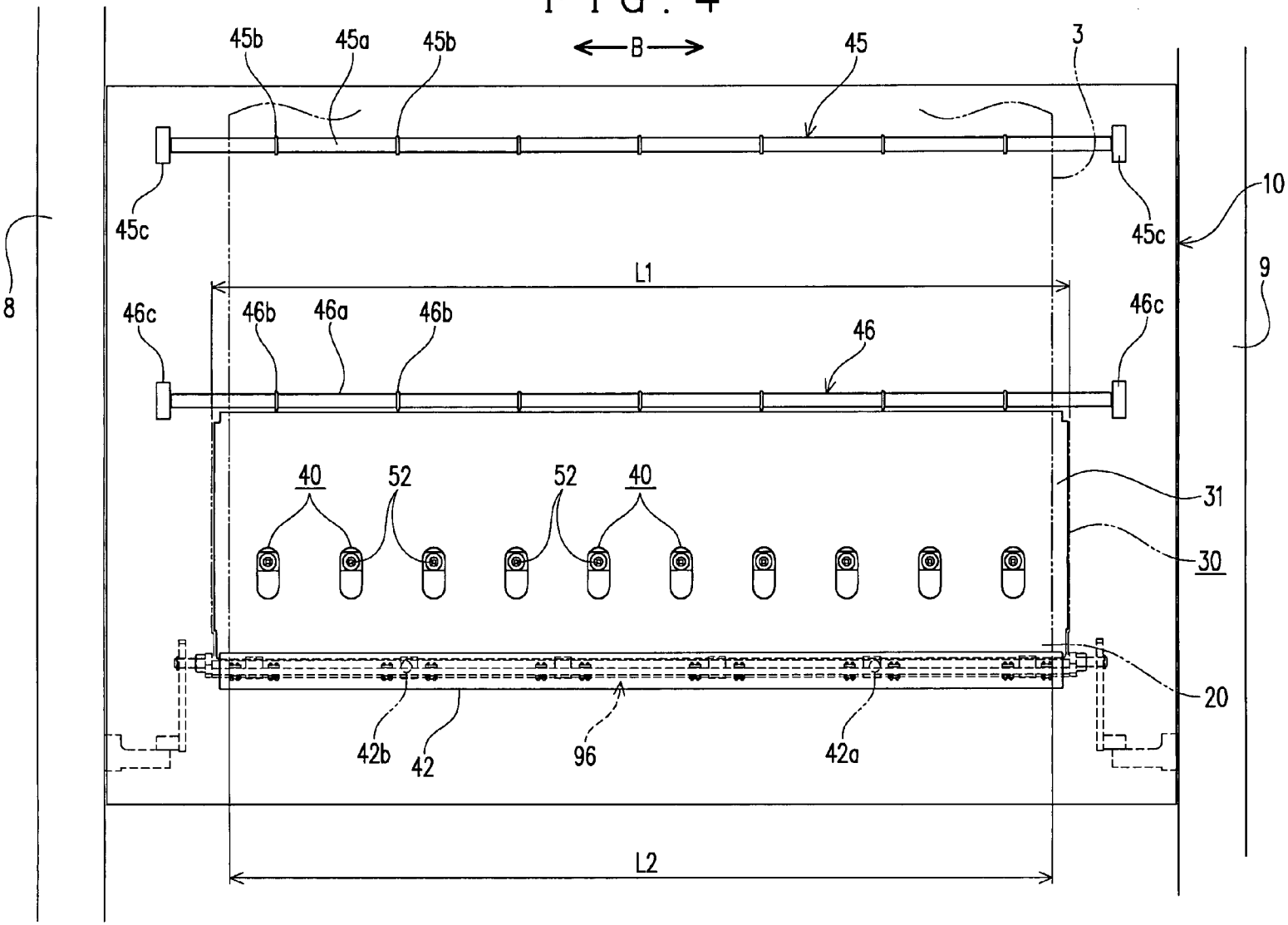
FIG. 4 is a front view of a downstream sided front panel of the printing press.
Figure 5:
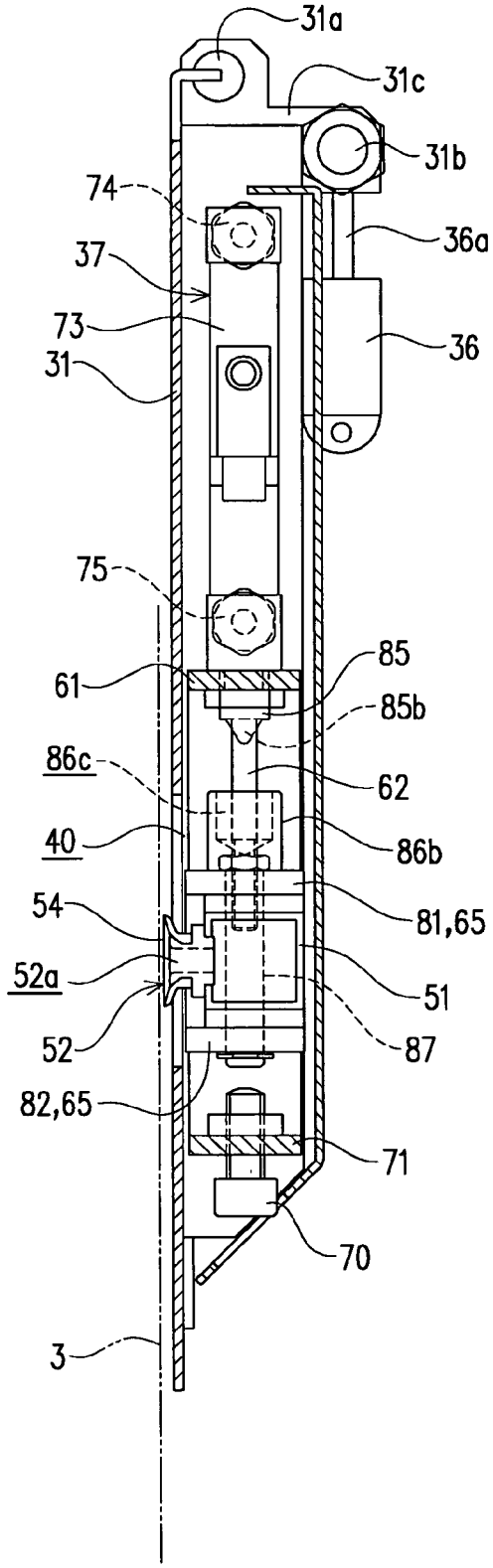
FIG. 5 is a lateral cross sectional view of the downstream sided front plate with the plate supply device.
Figure 6:
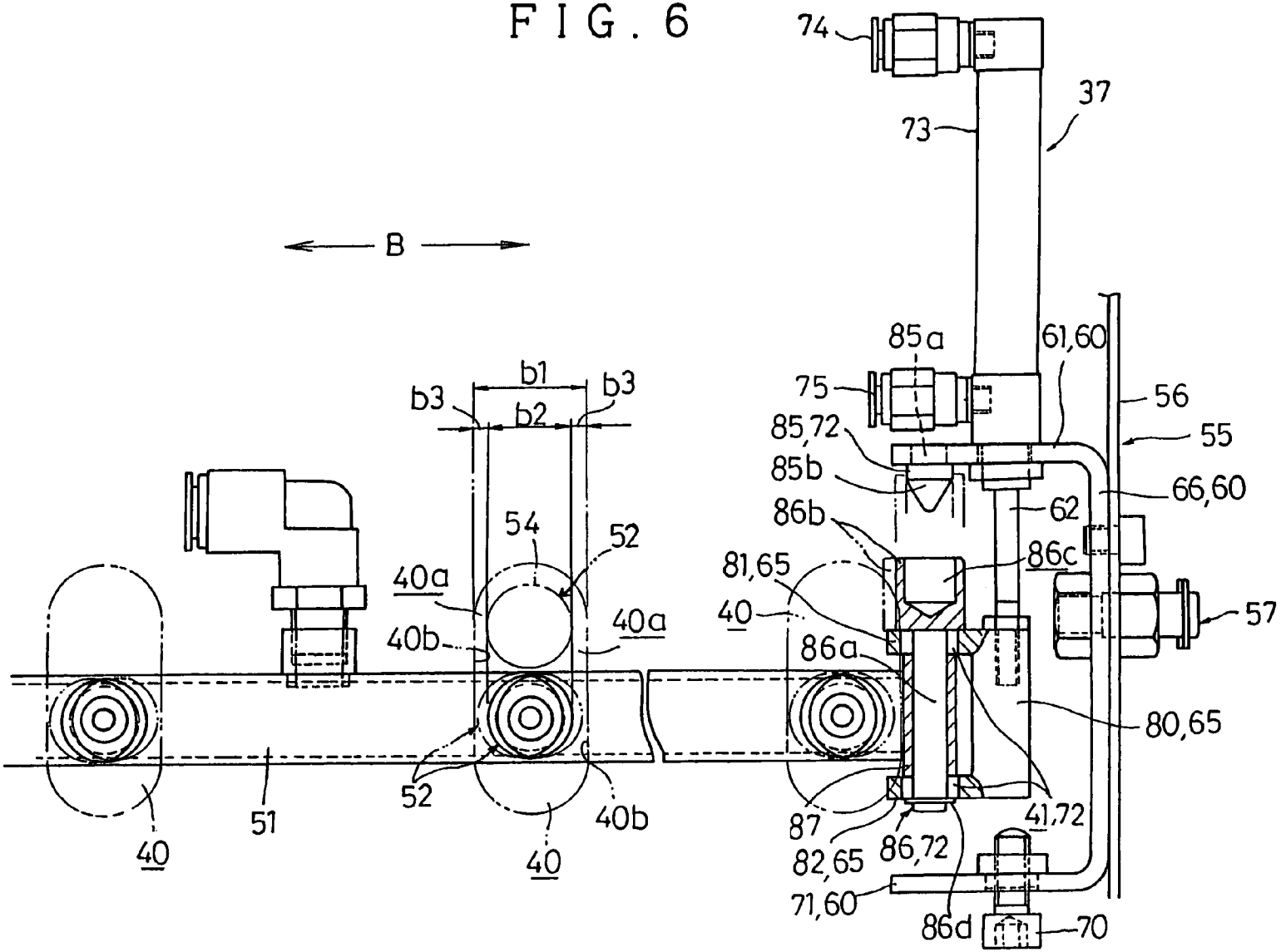
FIG. 6 is an enlarged view of the plate supply device with a partly broken-out section.
Figure 7:
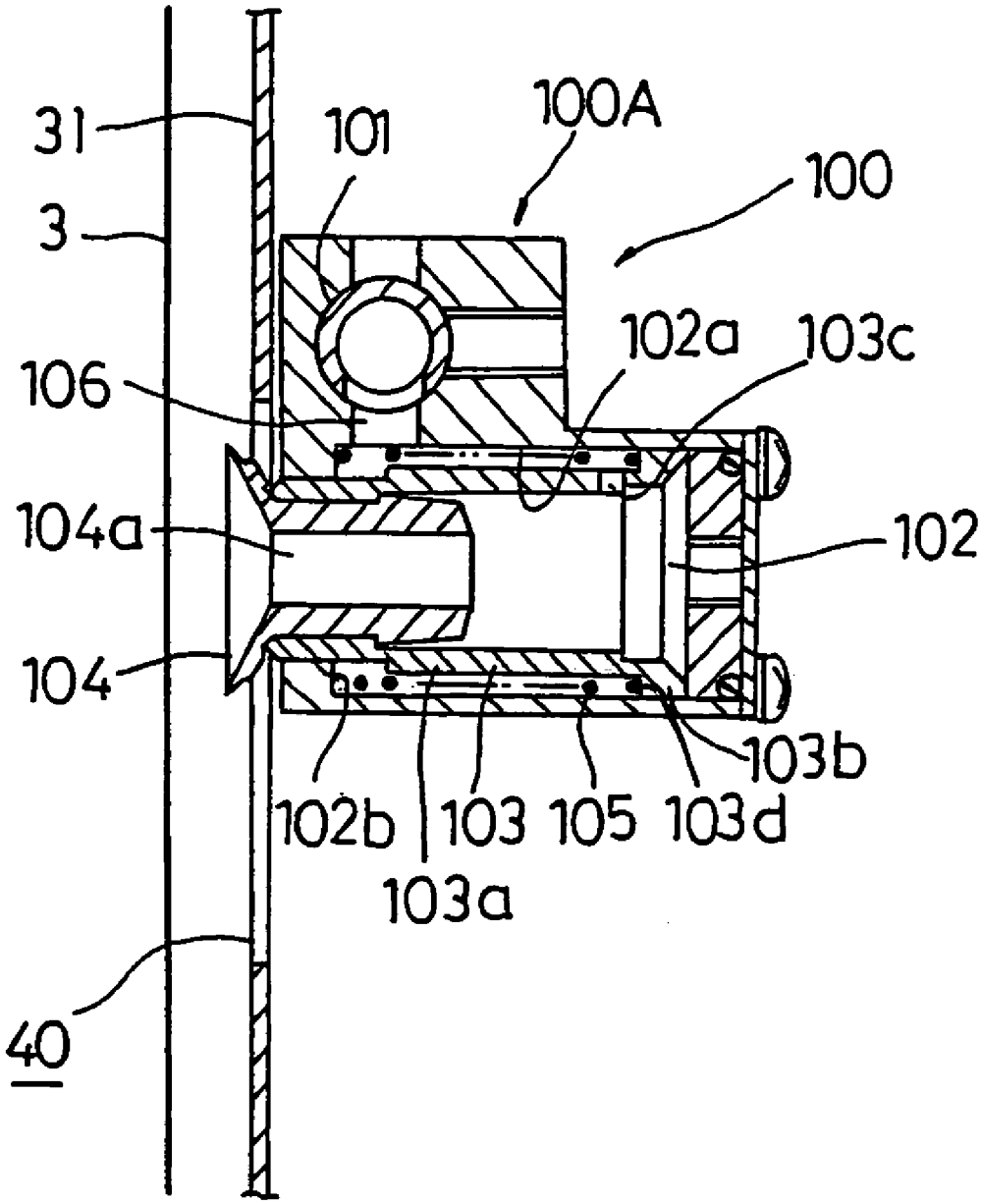
FIG. 7 is a cross sectional view illustrating a suction nozzle of a sucker in a pre-suction state before sucking a printing plate, according to another embodiment of the present invention.

Now, the description will be made for an embodiment of a printing press by taking for example a sheet-fed printing press with reference to the drawings attached hereto. FIGS. 1 and 2 are schematic lateral cross sectional views of a printing section of a sheet-fed printing press. FIG. 3 is a rear view of a printing plate guide plate illustrating the structure of a plate supply device. FIG. 4 is a front view of a downstream sided front plate. FIG. 5 is a lateral cross sectional view illustrating the structure of the plate supply device. FIG. 6 is an enlarged view of a partly broken-out section of FIG. 3.

Generally, a sheet-fed printing press has a sheet feeding section on the upstream side, a sheet discharge section on the downstream side and a printing section (also called as a printing unit) therebetween. All the Figures attached hereto illustrate the structure of a printing section 1. In this embodiment, only the single printing section 1 is illustrated for ease of explanation, although plural numbers of printing sections are to be set out between the sheet feeding section and the sheet discharge section according to the number of ink colors to be used for printing.

As illustrated in FIGS. 1 and 2, the printing section 1 includes a body cover 2, a plate cylinder 4 disposed inside of the body cover 2 for mounting of a printing plate 3 thereon, an inking device with plural ink rollers 6 for supplying ink to the plate cylinder 4, and a plate supply device A for supplying the printing plate 3 to the plate cylinder 4. The plate cylinder 4 is rotatably supported by opposite lateral plates 8, 9 via a support shaft 4*a*. A reference numeral 5 represents a rubber cylinder (a blanket cylinder) to be held in contact with the plate cylinder in a rotatable manner.

The body cover 2 includes a downstream sided front panel 10 disposed on a downstream side B1 between the opposite lateral plates 8, 9. The downstream sided front panel 10 is mounted between the opposite lateral plates 8, 9 in such a manner as to be movable in the vertical direction, thereby enabling closing and opening of the downstream side B1 between the opposite lateral plates 8, 9.

The plate cylinder 4 includes a known clamping gripper 15 for gripping the printing plate 3, which includes a leading-edge clamping member 21 for gripping a leading edge 20 (as a gripper receiving edge) of the printing plate 3 and a trailing-edge clamping member 23 for gripping a trailing edge 22 of the printing plate 3, both members being disposed in pair in the circumferential direction. As illustrated in FIG. 3, the leading-edge clamping member 21 has a pair of protrusions 25, 26 each having a cylindrical column shape disposed with a given distance from each other in an axial direction B of the plate cylinder 4 (hereinafter referred to a width direction B). The leading edge 20 of the printing plate 3 forms cutouts 27, 28 for engagement with the protrusions 25, 26. At least one of the cutouts 27, 28 has a bottom wall 27*b* or 28*b* of a semi-circular shape having a curvature substantially corresponding to a curvature of an outer circumference 25*a* or 26*a* of the protrusion 25 or 26, and lateral side walls 27*a*, 28*a* extending straightforward from the opposite ends of each of the bottom walls 27*b*, 28*b*.

As illustrated in FIGS. 3 and 4, the downstream sided front panel 10 has a lower portion forming an opening 30 of a rectangular shape for insertion of the printing plate 3. The plate supply device A has a printing plate guide plate 31 for opening and closing the opening 30. The printing plate guide plate 31 has a width L1 greater than a width L2 of the printing plate 3. The printing plate guide plate 31 is pivotally movably mounted via a support shaft 31*a* extending between the opposite lateral portions of the rear side of the downstream sided front panel 10. The downstream sided front panel 10 has lateral portions 35 to which cylinder devices 36 are pivotally movably mounted so as to shift the printing plate guide plate 31 between a printing plate setting position C1 at which the opening 30 is closed with the guide plate 31 and a printing plate supply position C2 at which the guide plate 31 is pivotally moved towards the clamping gripper 15. A leading end of a rod 36*a* of each cylinder device 36 is mounted to an operation shaft member 31*b* parallel to the width direction B so as to control the position of the printing plate guide plate 31. This operational shaft member 31*b* is connected via a connection member 31*c* to a support shaft 31*a* that extends parallel to the width direction, around which support shaft 31*a* the printing plate guide plate 31 is pivotally moved. The support shaft 31*a* is pivotally movably mounted to a corresponding one of the lateral portions 35 of the downstream sided front panel 10. The printing plate guide plate 31 is pivotally moved integrally with the support shaft 31*a* via the connection members 31*c* by moving forward and backward the rods 36*a* upon driving of the cylinder devices 36 so as to be shifted between the printing plate setting position C1 and the printing plate supply position C2. A plate surface of the printing plate guide plate 31 has plural elongated holes 40 extending along the plate surface in a direction orthogonal to the width direction B (hereinafter referred to a vertical direction) and aligned to each other in the width direction B.

The plate supply device A has on the front side of the downstream sided front panel 10 a receiving frame member 42 having a length substantially equal to the width of the printing plate guide plate 31 and located downstream of a lower edge of the opening 30 in an overlapping manner therewith. The receiving frame member 42 has on the side facing the printing plate guide plate 31 a pair of positioning members (protrusions 42*a*, 42*b*) that are engageable with portions (cutouts 27, 28) of the printing plate 3, through which the printing plate 3 is supported in position. Provided between the lower portion of the printing plate guide plate 31 and the receiving frame member 42 is a clearance for allowing the insertion of the leading edge 20 of the printing plate 3 when the opening 30 is closed with the printing plate guide plate 31. A pair of printing plate guide rods 45, 46, which are located in parallel above and below each other, are rotatably mounted via brackets 45*c*, 46*c* on the front upper portion of the downstream sided front panel 10, both rods being greater in length than the printing plate 3 in the width direction B. These printing plate guide rods 45, 46 are disposed with a given distance in the vertical direction, each having a clearance of a distance allowing for passing of the printing plate 3 therethrough from the front side of the downstream sided front panel 10. The printing plate guide rods 45, 46 each have large diameter portions 45*b*, 46*b*, which are slightly greater in diameter than ordinary diameter portions 45*a*, 46*a* between the opposite ends of the printing plate guide rods 45, 46.

The plate supply device A has a sucker 50 for sucking a rear side of the printing plate 3 and holding the printing plate 3. The sucker 50 is disposed on the rear side of the printing plate guide plate 31. The sucker 50 includes a suction pipe 51 having a length smaller than the printing plate guide plate 31 in the width direction and plural suction nozzles 52 protruding forward from the suction pipe 51 so as to be respectively inserted into the elongated holes 40. This sucker 50 is shiftable between a suction position E1 allowing the suction nozzles 52 to be held at the upper portions of the corresponding elongated holes 40 and suck the printing plate 3, and a plate supply position E2 allowing the suction nozzles 52 with the printing plate 3 sucked therewith to be held at the lower portions of the corresponding elongated holes 40, that is, held close to the clamping gripper 15. The suction pipe 51 with opposite ends closed is connected to a suction pump (not shown) via a suction joint 53 connected to a middle portion of the suction pipe 51.

As illustrated in FIG. 5, the suction nozzles 52 are mounted to the suction pipe 51 so as to respectively have nozzle ports 54 slightly protruding forward from the printing plate guide plate 31, and each have at its center a suction hole 52*a* for communication with the suction pipe 51. As illustrated in FIG. 6, a width b1 of each elongated hole 40 is larger than a maximum diameter b2 of the nozzle port 54 of the corresponding suction nozzle 52, so that clearances 40*a* each having a width b3 are provided between opposite circumferential walls 40*b* of the elongated hole 40 and the nozzle port 54.

A pair of support devices 55 are provided to support the suction pipe 51, allowing the suction pipe 51 to be reciprocated in the vertical direction, and allowing the same to be reciprocated along the plate surface of the printing plate guide plate 31 in the width direction B. The pair of support devices 55 are mounted at the opposite ends of the sucker 50 in the width direction B on the rear side of the printing plate guide plate 31. The both support devices 55 have an identical structure, and therefore the description will be made only for one of the support devices 55. The support device 55 includes a bracket 60 fixed to a bent plate portion 56, which is formed by bending a lateral portion of the printing plate guide plate 31*a*, with a fixing means 57 in the form of a bolt and a nut, a cylinder device (air cylinder device) 37 as a shifting means fixed to an upper plate portion 61 of this bracket 60, a support block 65 as a support member fixed to a leading end of a rod 62 of the cylinder device 37, and a block positioning mechanism 72 provided to the support block 65 and the upper plate portion 61 of the bracket 60.

The bracket 60 has a mounting portion 66 for allowing itself to be fixed to the bent plate portion 56 via the fixing means 57, the upper plate portion 61 formed by bending an upper part of the mounting portion 66, and a lower plate portion 71 formed on the lower part of the mounting portion 66 and having a stopper 70 (hereinafter described), thus forming a reversed C-shape with its left-hand side opened when viewed from the front side. The cylinder device 37 is designed to allow the rod 62 to be vertically reciprocated by having a cylinder portion 73 fixed to the upper plate portion 61 in the vertical direction. Air supply joints 74 and 75 are provided on the lateral sides of the opposite longitudinal ends of the cylinder portion 73.

The support block 65 has a dimension smaller than the height in the lengthwise direction of the mounting portion 66 of the bracket 60 and disposed between the upper plate portion 61 and the lower plate portion 71. This support block 65 has a body 80 fixed to the leading end of the rod 62, and support pieces 81, 82 respectively disposed on the opposite sides of the body 80 in the lengthwise direction (vertical direction), substantially parallel to the upper and lower plate portions 61, 71, thus forming a reversed C-shape with its left-hand side opened when viewed from the front side. The stopper 70 is disposed opposite to the body 80 of the support block 65 in the lengthwise direction so as to have an upper end protruding upward from the lower plate portion 71 towards the body 80 of the support block 65.

The block positioning mechanism 72 has a protrusion 85 mounted on the upper plate portion 61 of the bracket 60, a moving member 86 extending through the support pieces 81, 82 of the support block 65, and an elongated hole 41 formed in the support pieces 81, 82 for allowing a shaft portion 86*a* of the moving member 86 to be inserted therein in such a manner as to be movable in the width direction B.

The protrusion 85 has a proximal end 85*a* inserted into the upper plate portion 61 of the bracket 60 and mounted thereto, while the protrusion 85 has a distal end 85*b* having a cone shape with a gradually decreasing diameter. A head 86*b* of the moving member 86 has a diameter larger than the elongated hole 41 and has at its center a recess 86*c* for allowing the distal end 85*b* of the protrusion 85 to be brought into and out of engagement therewith. The moving member 86 has an end provided with a retaining member 86*d* for preventing the shaft portion 86*a* of the moving member 86 from falling from the elongated hole 41. A corresponding one of the opposite ends of the suction pipe 51 is located between the support pieces 81, 82 of the support block 65 and is integrally formed with a closing member 87 fitted around the shaft portion 86*a* of the moving member 86 for closing the corresponding one of the opposite ends of the suction pipe 51. The distal end 85*b* of the protrusion 85 is selectively brought into and out of engagement with the head 86*b* (recess 86*c*) of the moving member 86 so as to make the moving member 86 function as a switching member so that the suction nozzles 52 are held in non-movable manner in a direction parallel to the axis of the plate cylinder 4 at a position at which the suction nozzles 52 start holding the printing plate 3 by suction, and released from such a restricted condition when the printing plate 3 has reached a given position on the way towards the clamping gripper 15.

The plate supply device A has an auxiliary guide device 96 for guiding the printing plate 3 during the plate supply and discharge operations. The auxiliary guide device 96 includes a pivotally moving plate 97 supported at the opposite axial ends of the downstream sided front panel 10 via a support shaft 96*a*. The pivotally moving plate 97 includes a rod member 98 disposed at its leading end, supply plate guide rollers 99 mounted at intervals on the rod member 98 so as to contact the surface of the printing plate 3 only when the printing plate 3 is to be supplied, and discharge plate guide members (not shown) mounted on the rod member 98 between the adjacent supply plate guide rollers 99 for guiding the printing plate 3 by the contact therewith when the printing plate 3 is to be discharged. The pivotally moving plate 97 is designed to have different tilting angles relative to a horizontal plane P respectively for the plate supply operation and the plate discharge operation by using a link mechanism or the like (not shown). Specifically, the pivotally moving plate 97 is substantially parallel to the horizontal plane P in the plate discharge operation, and is tilted upward by an angle θ relative to the horizontal plane P in the plate supply operation. Thus, the pivotally moving plate 97 is pivotally moved to select whether the supply plate guide rollers 99 are to contact the printing plate 3 or the discharge plate guide members are to contact the printing plate 3 every time the operation is changed from the plate supply operation to the plate discharge operation or vice versa. The reason why such operation is to be made is to prevent ink of the printing plate 3 (used plate) from being attached to the printing plate 3 (new plate) during the plate supply operation. This operation allows ink to be attached only to the discharge plate guide members when in the plate discharge operation, while preventing the same from being attached to the supply plate guide rollers 99. This makes it possible to prevent ink from being attached to the newly supplied printing plate 3.

As illustrated in FIGS. 1 and 2, the printing section 1 has a plate discharge device 90 for discharging the printing plate 3 mounted on the plate cylinder 4 through an upper portion of the downstream sided front panel 10. The plate discharge device 90 is disposed on the rear upper side of the downstream sided front panel 10 and has a pair of discharge plate guide plates 91, 92 disposed adjacent to each other, and clamping rollers 93, 94 for clamping the printing plate 3 from the front and rear sides (opposite sides). The clamping rollers 93, 94 are disposed so as to be vertically movable by a common air cylinder (not shown) along the discharge plate guide plates 91, 92, in which the clamping roller 94 is disposed so as to be vertically movable along the discharge plate guide plates 91, 92 and be movable towards and away from the clamping roller 93 along with this vertical motion. That is, the clamping roller 94 is spring urged by a spring (not shown) towards the clamping roller 93. A stay 95 is provided on the downstream sided front panel 10 to keep the clamping roller 94 away from the clamping roller 93 when the clamping roller 94 is located at a lower side.

Now, the description will be made for the mounting operation to mount the printing plate 3 on the plate cylinder 4 in the thus arranged printing section 1. In this case, the operator inserts the printing plate 3 into a clearance between the front side of the downstream sided front panel 10 and the printing plate guide rod 45 while holding the printing plate guide plate 31 at the printing plate setting position C1 at which the opening 30 is closed. Then, the printing plate 3 is moved downward so as to be inserted into a clearance between the front side of the downstream sided front panel 10 and the printing plate guide rod 46 and hence has the leading edge 20 inserted between the printing plate guide plate 31 and the receiving frame member 42. The printing plate 3 is held in position by bringing the cutouts 27, 28 as the engaged means formed in the leading edge 20 of the printing plate 3 into engagement with the protrusions 42*a*, 42*b* as the engaging means of the receiving frame member 42.

Then, the operator operates a suction switch (not shown) to drive the suction pump of the sucker 50, thereby transmitting a suction force of the suction pump to the respective suction nozzles 52 via the suction pipe 51 so as to suck the rear surface of the printing plate 3, allowing a portion of the printing plate 3 close to the leading edge 20 to be held along the printing plate guide plate 31. In this case, the suction pipe 51 is positioned in the upper regions of the elongated holes 40 and therefore the suction nozzles 52 are also held at the suction position E1 that lies in these upper regions. At this moment, the cylinder device 37 has not yet been driven and therefore has the rod retracted with the distal end 85*b* of the protrusion 85 held in engagement with the head 86*b* (recess 86*c*) of the moving member 86. This engagement thus prevents the suction nozzles 52 from being moved in the width direction B in the upper regions of the respective elongated holes 40 and therefore allows the suction nozzles 52 to securely hold the printing plate 3 by suction.

Then, the operator operates a plate supply switch (not shown) to stop the leading-edge clamping member 21 at a position at which the leading edge 20 of the printing plate 3 is to be inserted, and subsequently drive the cylinder devices 36 with a periphery of the leading edge 20 of the printing plate 3 held along the printing plate guide plate 31 so that the printing plate guide plate 31, which has been closing the opening 30 until then, is pivotally moved towards the plate cylinder 4 around the support shaft 31*a* (in an anticlockwise direction of FIG. 1) and then shifted to the printing plate supply position C2. By this motion, the leading edge 20 of the printing plate 3 is moved close to the clamping gripper 15, specifically the leading-edge clamping member 21, of the plate cylinder 4. On the other hand, along with the pivotal motion of the printing plate guide plate 31 towards the plate cylinder 4, the pivotally moving plate 97 of the auxiliary guide device 96, which has been substantially horizontally held until then, is pivotally moved by an angle θ relative to the horizontal plane P as represented in phantom lines so as to allow the rod member 98 disposed at the leading end of the pivotally moving plate 97 to move closer to the leading edge 20 on the printing plate guide plate 31.

Upon the detection of the fact that the printing plate guide plate 31 has been brought into the printing-plate supply position C2, the cylinder device 37 is driven to extend the rod 62, which allows the support block 65 to move towards the stopper 70 along the printing plate guide plate 31 through the body 80 mounted to the rod 62. On the other hand, the distal end 85*b* of the protrusion 85, which has been held in engagement with the head 86*b* (the recess 86*c*) of the moving member 86 until then, is released from the engagement with the same, and the sucker 50 is moved to the plate supply position E2 at which the suction nozzles 52 are positioned in the lower regions of the elongated holes 40. Then, with the arrangement in which the suction pipe 51 is mounted to the support block 65 via the moving member 86 and the closing member 87, and the suction nozzles 52 are mounted to the suction pipe 51, the suction nozzles 52 move to the leading-edge clamping member 21 of the clamping gripper 15 along the elongated holes 40 while holding the printing plate 3 by the suction force when the support block 65 moves towards the stopper 70 along the printing plate guide plate 31.

When the sucker 50 has moved to the plate supply position E2 with the printing plate 3 positioned correctly relative to the plate cylinder 4 in the width direction B, the cutouts 27, 28 formed in the leading edge 20 of the printing plate 3 are respectively engaged with the protrusions 25, 26 of the leading-edge clamping member 21. Upon the engagement of the cutouts 27, 28 of the leading edge 20 of the printing plate 3 with the protrusions 25, 26 of the leading-edge clamping member 21, the cylinder device 37 stops further extension of the rod 62 by a load resulting from the engaging force since the suction force of the sucker 50 for holding the printing plate 3 is sufficiently greater than the driving force of the cylinder device 37. In this state, the leading-edge clamping member 21 is driven to clamp the leading edge 20 of the printing plate 3.

Thus, with the cutouts 27, 28 of the printing plate 3 held in engagement with the protrusions 25, 26 of the leading-edge clamping member 21, the cylinder device 37 stops before the support block 65 contacts the stopper 70 so that the sucker 50 moves to a given plate supply position E2 and stops its further movement, even if the support block 65 moves towards the stopper 70 along the printing plate guide plate 31. However, in such a case where the operator erroneously operates the suction switch when the printing plate 3 is not inserted in the clearance between the front side of the downstream sided front panel 10 and the receiving frame member 42, the cutouts 27, 28 of the printing plate 3 do not engage with the protrusions 25, 26 of the leading-edge clamping member 21 and therefore the rod 62 keeps its extending motion with no load applied to the cylinder device 37. This extension of the rod 62 of the cylinder device 37 is however stopped by the application of a load to the cylinder device 37, which results from the contact of the support block 65 with the stopper 70.

Now, the description will be made for the case where the printing plate 3 is not correctly positioned relative to the plate cylinder 4 in the width direction B. In this case, the cutouts 27, 28 are out of alignment with the protrusions 25, 26 in the width direction B and therefore they are unlikely to be engaged with each other. In order to address this problem, the block positioning mechanism 72 is provided at each of the opposite ends of the sucker 50. That is, the block positioning mechanism 72 at each end has the elongated hole 41 in the support pieces 81, 82 for allowing the shaft portion 86*a* of the moving member 86 to be inserted thereinto while being movable in the width direction B, and the protrusion 85 is positioned away from the head 86*b* of the moving member 86 so that the moving member 86 is held in such a manner as to be movable along the elongated hole 41 at the plate supply position E2 of the sucker 50. That is, until the head 86*b* of the moving member 86 is moved away from the distal end 85*b* of the protrusion 85 upon the driving of the cylinder device 37, the rod 62 is held in an extension state at a given position, allowing the moving member 86 and the suction nozzles 52 to be released from the engaged state in which they are prevented from being moved in the axial direction and therefore to be movable in the width direction B.

With the thus arranged positioning mechanism 72 provided at each end of the sucker 50, when the leading edge 20 of the printing plate 3 has been moved towards the leading-edge clamping member 21 at the printing-plate supply position C2 at which the printing plate guide plate 31 has been pivotally moved towards the clamping gripper 15 so as to open the opening 30, the cutouts 27, 28, which happened to be out of alignment with the protrusions 25, 26 in the width direction B, are brought into alignment with the same, as long as a slight engagement or only a kind of hooking engagement (not requiring a full engagement) is present between the outer circumferences 25*a*, 26*a* of the cylindrical protrusions 25, 26 and the lateral side walls 27*a*, 28*a* of the cutouts 27, 28, which engagement causes the protrusions 25, 26 to press the lateral side walls 27*a*, 28*a* of the cutouts 27, 28, thus bringing the cutouts 27, 28 into alignment with the protrusions 25, 26 and hence allowing the printing plate 3 to be mounted at a correct position relative to the plate cylinder 4 in the width direction B.

Then, the suction nozzles 52, which together suck the printing plate 3 and hold the same tightly, allow themselves and the suction pipe 51 to move along with the printing plate 3 towards the leading-edge clamping member 21, while moving in the width direction B, so that the leading edge 20 of the printing plate 3 is clamped by the driving of the leading-edge clamping member 21. Meanwhile, it is assumed that, even if the printing plate 3 is not mounted at a correct position relative to the plate cylinder 4 in the width direction B, the displacement therebetween is generally small. Therefore, even with a slight engagement or only a kind of hooking engagement (not requiring a full engagement) between the cutouts 27, 28 and the protrusions 25, 26, the protrusions 25, 26 can press through their outer circumferences the lateral side walls 27*a*, 28*a* of the cutouts 27, 28 so that the printing plate 3 can be correctly positioned with respect to the width direction B.

The anticlockwise rotation (FIG. 1) of the plate cylinder 4 with the leading-edge clamping member 21 driven and having been clamping the leading edge 20 of the printing plate 3 causes the printing plate 3 to be mounted on the plate cylinder 4. At this moment, the pivotally moving plate 97 is pivotally moved upward by the angle θ relative to the horizontal plane P, and therefore allows the printing plate 3 to be guided along the supply plate guide rollers 99 disposed on the pivotally moving plate 97. Then, the trailing-edge clamping member 23 of the clamping gripper 15 clamps the trailing edge 22 of the printing plate 3, allowing the printing plate 3 to be tightly mounted on the plate cylinder 4. Thus, the printing section is set in a state for starting a printing operation. On the other hand, once the mounting operation of the printing plate 3 on the plate cylinder 4 has been finished, the cylinder device 37 is again driven to have its rod 62 return towards the cylinder portion 73. Whereby, the sucker 50 entirely moves upward; the suction nozzles 52 return to the suction position E1 at which they suck the printing plate 3 to be subsequently supplied; the protrusion 85 of the block positioning mechanism 72 at each end of the sucker 50 engages with the head 86*b* of the moving member 86; and the sucker 50 is entirely fixed in position in such a manner as to be non-movable relative to the width direction B. Substantially at the same time, the printing plate guide plate 31 returns from the printing plate supply position C2 to the printing plate setting position C1 by the driving of the cylinder devices 36. At this moment, the pivotally moving plate 97 returns to its original positions at which it is held in the substantially horizontal orientation.

For discharging the printing plate 3 upon the finish of the printing, the plate cylinder 4 is rotated so as to move the clamping gripper 15 to a given position, and the trailing edge 22 of the printing plate 3 is released from the clamped engagement with the trailing-edge clamping member 23. Whereby, the trailing edge 22 of the printing plate 3 is removed away from the plate cylinder 4 via the spring force of the printing plate 3 and brought into engagement with the discharge plate guide members of the pivotally moving plate 97 held in the substantially horizontal orientation. Then, the plate cylinder 4 is rotated in the clockwise direction of FIG. 2, thereby moving a portion of the printing plate 3 subsequent to the trailing edge 22 away from the plate cylinder 4 and hence allowing the trailing edge 22 of the printing plate 3 to be drawn into a space between the discharge plate guide plates 91, 92. Then, the leading-edge clamping member 21 releases its clamping engagement with the trailing edge 22 of the printing plate 3 at a given position. Thus, the printing plate 3 with its middle portion clamped from the opposite sides by the clamping rollers 93, 94 is discharged through the upper portion of the downstream sided front panel 10 to the outside of the body cover 2 upon the vertical motions of the clamping rollers 93, 94 effected by the driving of the cylinder device.

As described above, in the above embodiment of the present invention, the cylinder device 37 as a moving means has the rod 62 that is moved forward and backward in the plate supply direction and is provided with the support block 65 fixed thereto. The moving member 86 is mounted to the support block 65 in such a manner as to be movable in the width direction B of the plate cylinder 4 and the sucker 50 is mounted to the moving member 86. Accordingly, even when supplying the printing plate 3, whose cutouts 27, 28 being out of alignment with the protrusions 25, 26 in the width direction B, to the clamping gripper 15 of the plate cylinder 4, while holding the same by the suction force of the sucker 50, the printing plate 3 is properly supplied to the clamping gripper 15 of the plate cylinder 4 while being corrected in position relative to the width direction B along with the sucker 50. These protrusions 25 26 press through their outer circumferences 25*a*, 26*a* the lateral side walls 27*a*, 28*a* of the cutouts 27, 28, allowing the printing plate 3 to be supplied to the leading-edge clamping member 21 while being corrected in position relative to the width direction B. This allows the leading-edge clamping member 21 to clamp the leading edge 20 of the printing plate 3 while holding the printing plate 3 at a correct position. Thus, it is possible to achieve accurate alignment of the printing plate 3 with the plate cylinder 4 during supplying the printing plate towards the clamping gripper 15.

Meanwhile, a conventional printing press of this type is required to have the plate registration (axial position) of the plate cylinder to the original point (position) for bringing the engaged means of a printing plate and the engaging means of the plate cylinder into alignment with each other. In this respect, according to the above embodiment of the present invention, even if the cutouts 27, 28 of a printing plate to be supplied to the clamping gripper 15 of the plate cylinder 4 are out of alignment with the protrusions 25, 26 relative to the width direction B, the printing plate 3 is corrected in position relative to the width direction along with the sucker 50 as it is supplied to the clamping gripper 15 of the plate cylinder 4. Therefore, it is possible to omit the necessity to perform an additional work such as returning the plate registration (axial position) of the plate cylinder 4 to the original point (position) for bringing the engaged means of a printing plate (a new plate) with the engaging means of the plate cylinder 4, and thus achieves an efficient printing operation.

The present invention is not necessarily limited to the above embodiment. FIGS. 7–10 illustrate another embodiment of the sucker. A sucker 100 as illustrated in these Figures has a casing 100A supported by the block positioning mechanism 72 having the same structure as that of the above embodiment, a suction pipe 101 extending through the casing 100A so as to be supported thereby and connected to a suction pump (not shown), plural piston chambers 102 defined by the casing 100A and held in communication with the suction pipe 101, cylindrical pistons 103 respectively and slidably fitted in the piston chambers 102, suction nozzles 104 respectively mounted to the distal ends of the pistons 103, and springs 105 for spring-urging the pistons 103 in such a direction as to make the suction nozzles 104 retract.

The piston chambers 102 communicate with the suction pipe 101 via communication holes 106 formed in the middle part of the suction pipe 101. The piston 103 in each piston chamber 102 has a body portion 103*a* having a diameter smaller than the inner diameter of the piston chamber 102 and a diametrically large portion 103*b* having a diameter substantially equal to the inner diameter of the piston chamber 102 so as to be slidingly engageable with a circumferential wall 102*a* of the piston chamber 102. The body portion 103*a* has a small hole 103*c*. The maximum diameter of each suction nozzle 104 is smaller than the axial width of the elongated hole 40. The suction nozzle 104 has in its center a suction hole 104*a* for communication between the piston chamber 102 and the outside thereof. The spring 105 is seated between a circumferential surface 102*b* of the piston chamber 102 close to the suction nozzle 104 and a circumferential surface 103*d* of the diametrically large portion 103*b*. The dimension of the small hole 103*c* is sufficiently smaller than the dimension of the communication hole 106.

Now, the description will be made for the motion of the sucker 100 when at the suction position E1 for the suction of the printing plate 3 by taking for example one of the piston chambers 102. Since the suction pipe 101 communicates with the piston chamber 102 via the communication hole 106, the piston chamber 102 is put into negative pressure as air is drawn therefrom by driving the suction pump. Since the dimension of the small hole 103*c* is sufficiently smaller than the dimension of the communication hole 106, the piston 103 is moved in such a direction as to protrude away from the elongated hole 40 (towards a left-hand side of FIG. 7) against spring force of the spring 105, and the suction nozzle 104 is also moved in such a direction as to protrude away from the elongated hole 40. Since a stepped surface 103*e* formed on the outer circumference of the piston 103 contacts the circumferential surface 102*b* during the movement of the piston 103, the length of the piston 103 away from the elongated hole 40 is limited.

Figure 8:
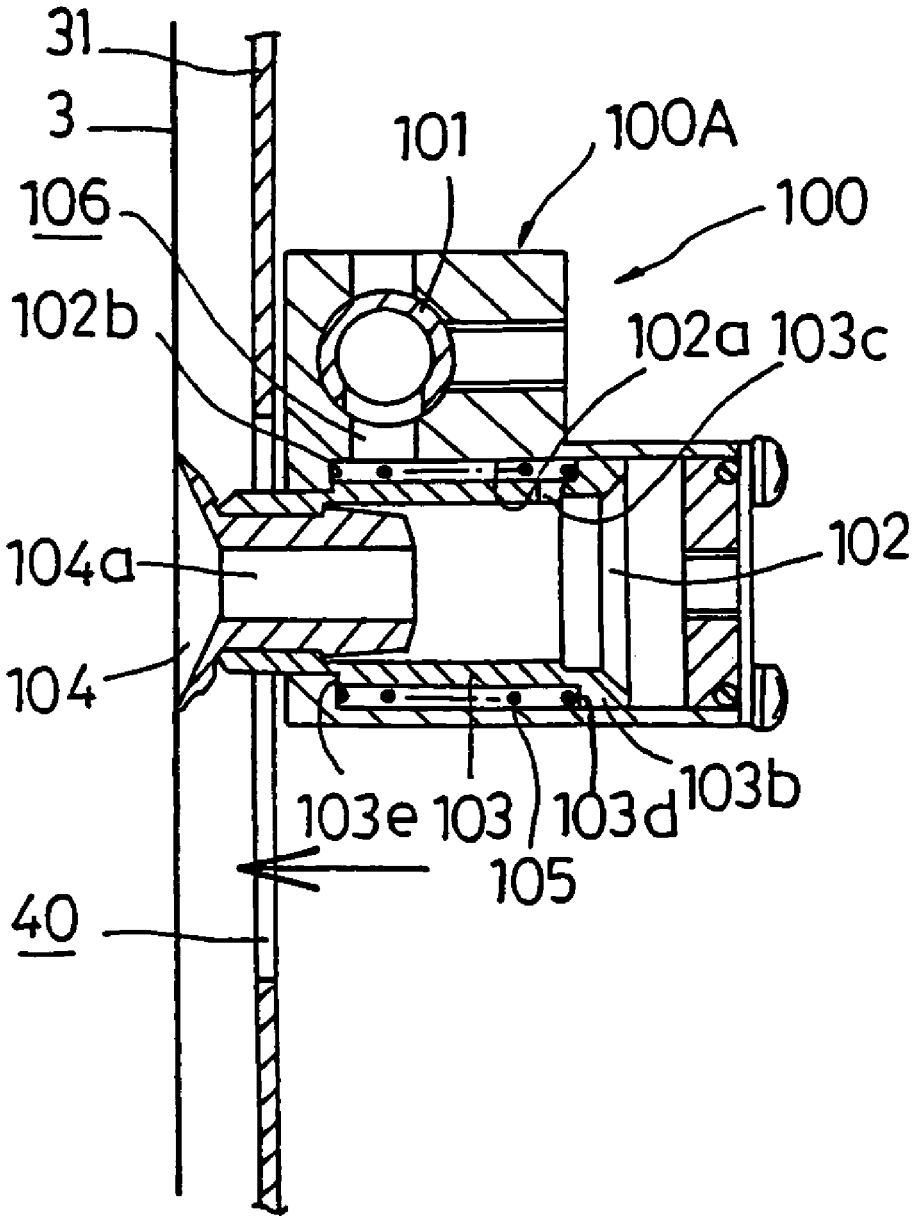
FIG. 8 is a cross sectional view illustrating the suction nozzle of the sucker in a sucking state.
Figure 9:
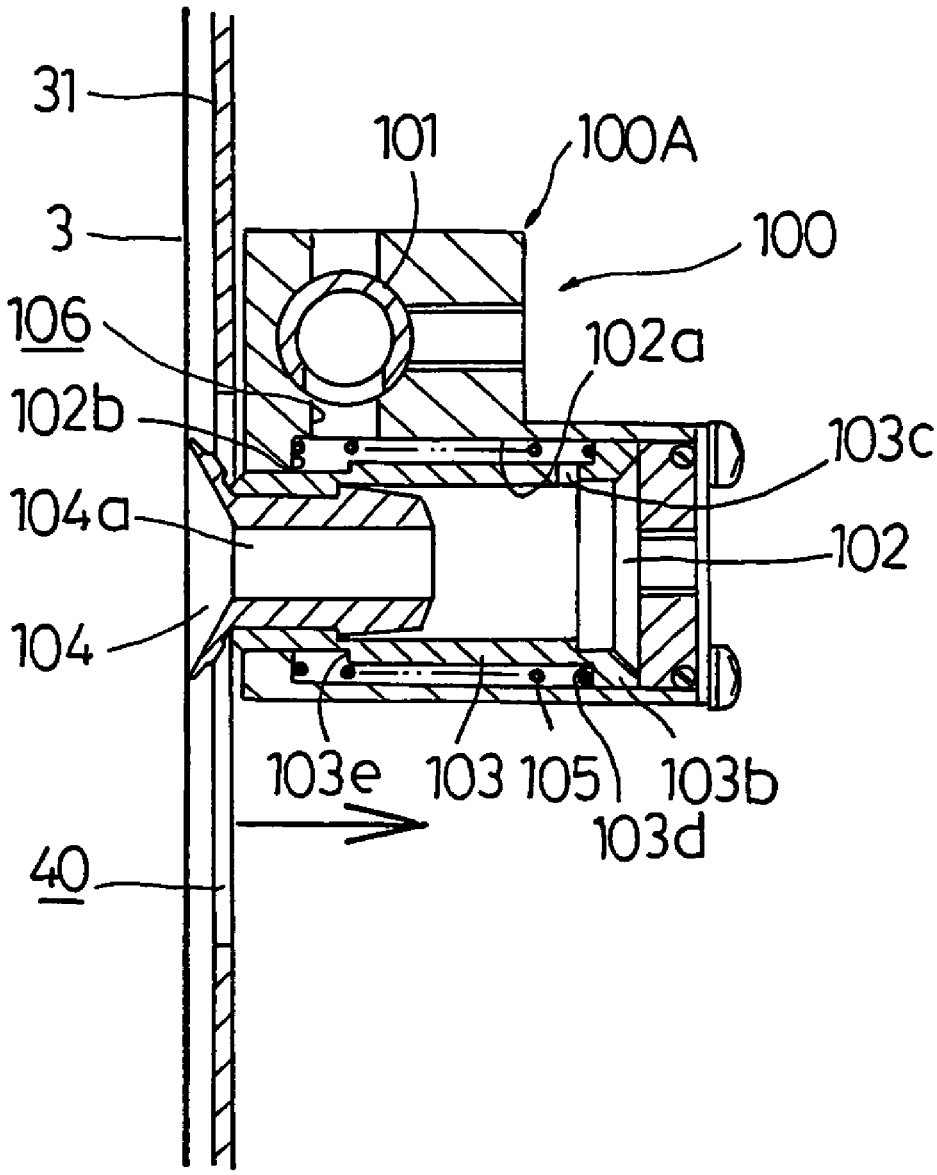
FIG. 9 is a cross sectional view illustrating the suction nozzle of the sucker in a retracted state while holding the printing plate by suction.
Figure 10:
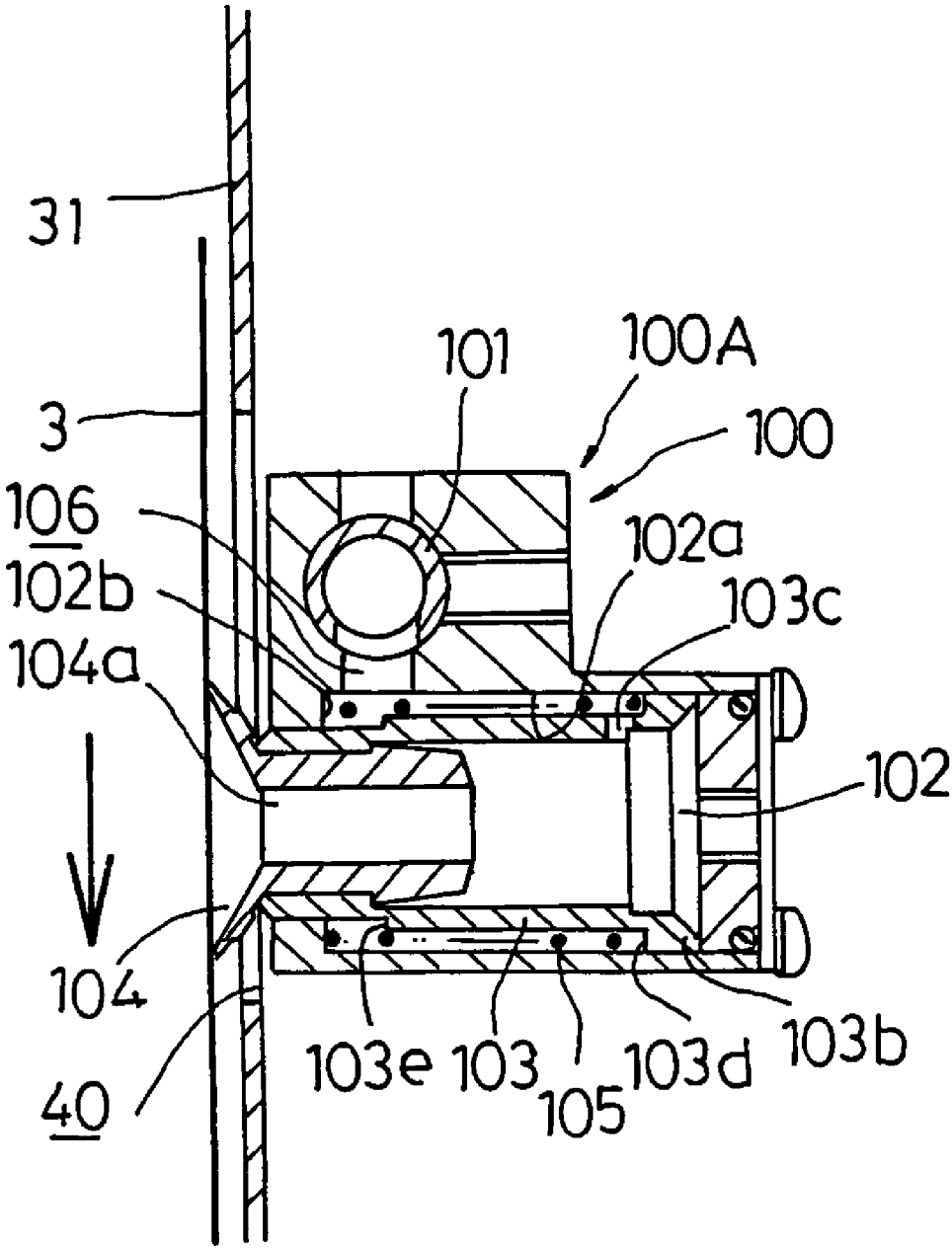
FIG. 10 is a cross sectional view illustrating the suction nozzle of the sucker which has been retracted and shifted to a different position while holding the printing plate by suction.

While the dimension of the small hole 103*c* is sufficiently smaller than the dimension of the communication hole 106, suction of air is made also through the suction hole 104*a* by the suction nozzle 104, which suction force allows the suction nozzle 104 to hold the printing plate 3, as illustrated in FIG. 8. With the printing plate 3 held by the suction nozzle 104, there is no room from which air can be drawn and hence this causes air pressure within the piston chamber 102 to equal the air pressure within the piston 103. Accordingly, the piston 103 is moved in such a direction as to be retracted from the elongated hole 40 (towards a right-hand side of FIG. 9). At this moment, the suction nozzle 104 still holds the printing plate 3 and therefore the printing plate 3 is also pulled towards the elongated hole 40. The sucker 100 is then moved downward with the printing plate 3 held by the suction nozzles 104, as illustrated in FIG. 10. This downward movement allows the sucker 100 to be brought into the suction position E1, at which the leading edge 20 of the printing plate 3 is drawn into the leading-edge clamping member 21 of the clamping gripper 15. Thus, the printing plate 3 can be supplied to the plate cylinder 4.

According to the above embodiments, the alignment of the printing plate 3 with the plate cylinder 4 is made through the engagement between the engaging means in the form of the protrusions 25, 26 and the engaged means in the form of the cutouts 27, 28, in which the lateral side walls 27*a*, 28*a* of the cutouts 27, 28 are pressed by the outer circumferences 25*a*, 26*a* of the protrusions 25, 26 in such a direction as to bring the printing plate 3 into alignment with the plate cylinder 4 relative to the width direction B. These engaging means and engaged means may be varied in structure, arrangement, number, shape or the like, as long as the engaged means is brought into alignment with the engaging means based on the engagement therebetween.

This specification is by no means intended to restrict the present invention to the preferred embodiments set forth therein. Various modifications to the printing press, as described herein, may be made by those skilled in the art without departing from the spirit and scope of the present invention as defined in the appended claims.

What is claimed is:

1. A printing press comprising:

a plate cylinder for mounting a printing plate thereon;

a clamping gripper disposed on said plate cylinder for gripping the printing plate;

a printing plate guide plate on which a printing plate to be guided is mounted;

a sucker for holding the printing plate by a suction force applied to a rear side of the printing plate so as to pull the printing plate towards the printing plate guide plate;

a plate supply device for supplying the printing plate held by the sucker towards the clamping gripper;

a support member provided in the plate supply device for movably supporting the sucker in a direction parallel to an axis of the plate cylinder; and engaging means being provided on the side of the plate cylinder for bringing the printing plate held by the sucker into a given position relative to the axis of the plate cylinder by engagement with engaged means formed in a leading edge of the printing plate so as to allow the printing plate to be brought into alignment with the plate cylinder relative to the axis of the plate cylinder.

2. The printing press according to claim 1, further comprising a moving member, through which the sucker is mounted to the support member in such a manner as to be movable in the direction parallel to the axis of the plate cylinder, and a switching means for switching the moving member so as to prevent the moving member from being moved in the direction parallel to the axis of the plate cylinder at a position at which the sucker starts holding of the printing plate by suction and allowing the moving member to be movable in the direction parallel to the axis of the plate cylinder at a position which the sucker reaches on its way towards the clamping gripper.

3. The printing press according to claim 1, wherein the engaging means comprises a pair of protrusions, each having a cylindrical column shape disposed with a given distance from each other in the direction parallel to the axis of the plate cylinder, and the engaged means comprises a pair of engaged members, at least one of the engaged members being a cutout formed in the leading edge of the printing plate, wherein said cutout has a width substantially equivalent to the diameter of a corresponding one of the pair of protrusions.

* * * * *